United States Patent [19]

Everett

[11] 4,442,858

[45] Apr. 17, 1984

[54] SURGE CHAMBER

[76] Inventor: Wilhelm S. Everett, P.O. Box 1535, Ventura, Calif. 93001

[21] Appl. No.: 346,727

[22] Filed: Feb. 8, 1982

[51] Int. Cl.[3] ..... F04D 27/02

[52] U.S. Cl. ..... 137/207; 137/590; 137/568

[58] Field of Search ..... 137/207, 209, 590, 568; 138/31

[56] References Cited

U.S. PATENT DOCUMENTS

| | | | |
|---|---|---|---|
| 2,946,345 | 7/1960 | Weltmer | 137/590 |
| 4,164,242 | 8/1979 | Sandan | 138/31 X |
| 4,301,827 | 11/1981 | Murthy | 137/207 |

*Primary Examiner*—Alan Cohan

*Attorney, Agent, or Firm*—Ralph B. Pastoriza

[57] ABSTRACT

A surge chamber has an outflow/inflow control fitting on its bottom so as to make maximum use of fluid in the chamber. The fitting itself includes a surge pipe section and outlet pipe section extending downwardly from the bottom of the chamber and having companion flanges. An annular nozzle member is positioned between the flanges and defines a reduced diameter opening. This opening is designed to pass fluid from the chamber to a pipeline to prevent fluid separation of the fluid column in the pipeline to prevent fluid separation of the fluid column in the pipeline should the normally provided pumping system fail. The fitting further includes a core member supporting anti-vortex blades and a deflection plate to minimize agitation of the fluid/air surface in the surge chamber as might otherwise occur during outflow and inflow of fluid.

6 Claims, 4 Drawing Figures

SURGE CHAMBER

FIELD OF THE INVENTION

This invention relates generally to surge chambers and more particularly to an improved outflow/inflow control fitting for a surge chamber for controlling fluid flow from the surge chamber to a pipeline in a manner to avoid water hammer in the pipeline.

BACKGROUND OF THE INVENTION

Surge chambers of the hydro-pneumatic type are normally used in conjunction with pumping plants and pipeline systems to avoid water hammer in the event of sudden pressure changes exerted on the fluid column in a pipeline. The surge chambers themselves are approximately half-full of fluid such as water and serve as stand-by pneumatic pumps which function when there is a power outtage or when the main pump system fails. Each surge chamber will deliver fluid to the pipeline system at a slowly decreasing rate, depending on the initial pneumatic air pressure in the chamber above the water surface. This feeding of fluid to the pipeline prevents the column of water in the pipeline system from "separating". In other words, a controlled gradually decreasing pressure is maintained on the water column in a manner analogous to maintaining pressure on a string of freight cars to prevent separation. Should separation occur, in either a water column or in the analogy of freight cars, when they reconnect, extensive damage can result. In the case of the fluid column, such reconnection of a separated water column is termed water "hammer".

The hydro-pneumatic surge chambers accordingly are very carefully designed with a known volume of pre-charged air and control outlet opening or orifice to carefully regulate the outflow of fluid from the chamber to a pipeline, so that column separation will not occur. Avoiding such column separation is accomplished by assuring that the pressure does not drop below some specified value.

Because the system using the surge chamber is essentially passive after a pump failure occurs, there will be a return surge or "oscillation" of the entire fluid column so that fluid will re-enter the surge chamber much like a geyser and recompress the air. If the outflow/inflow opening or orifice does not provide sufficient throttling, the air in the chamber may be compressed far above the initial operating pressure of the pumping system.

Further considerations in the design of surge chambers relate to assuring that no air is lost to the pipeline system from the surge chamber during outflow of fluid. If such air is lost, it would have to be rapidly replaced in time to enable the surge chamber to accommodate another power outtage or pump shutdown. A still further consideration in the design of such chambers, is to make sure that the fluid-air surface within the chamber or vessel is not agitated, since the fluid or water will tend to absorb the air under such agitation and thereby reduce the air volume which requires replacement.

In the past, surge chambers had their connections to a pipeline system in the side of the chamber or vessel with the reduced diameter orifice or nozzle portion located internally in a downcomer positioned within a few inches of the bottom of the tank, so that all of the surge volume can be employed. In fact, as early as 1917, I used a check valve as the communication connection between the interior of the surge tank in a pipeline with a hole in the flapper portion of the check valve. On the outflow or downsurge sequence, the check valve opened, allowing fluid in the surge chamber to run into the pipeline at a predetermined rate, depending upon the size of the connection line. On the return surge, the check valve closed and the hole in the flapper functioning as an orifice throttled the return surge. Later, I devised a swirl chamber as disclosed in U.S. Pat. No. 3,669,150 constructed within a surge chamber. At a later date, Fluid Kinetics Corp. used a venturi construction in the downcomer portion of the flow control fitting.

In most cases, surge tanks of potable water must have an internal coating for sanitary reasons. Any members or construction components within the surge tank must therefore also be coated, which becomes a vexing and expensive operation.

BRIEF DESCRIPTION OF THE PRESENT INVENTION

In accord with the present invention, a vastly improved surge chamber results by providing an outflow-/inflow control fitting on the bottom of the chamber so that internal structure such as downcomers can be avoided. In order to prevent the air-water or fluid surface from being depressed by formation of a vortex, much as occurs when water runs out of a bathtub, anti-vortex blades are provided in the fitting.

The fitting also includes a nozzle member defining a restricted orifice passage spaced below the anti-vortex blades and dimensioned to control fluid flow from the surge chamber to a pipeline containing fluid normally at a higher level in a manner to prevent fluid separation in said pipeline should the pumping system fail.

In the preferred embodiment of the invention, the core member extends into the restricted outlet flow passage to define an annular-shaped outflow/inflow passage in cross section. This core member also serves to support a baffle plate which will further minimize agitation of the fluid-air surface in the surge chamber during inflow of fluid on a return surge.

BRIEF DESCRIPTION OF THE DRAWINGS

A better understanding of this invention as well as further features and advantages thereof will be had by referring to the accompanying drawings in which.

DETAILED DESCRIPTION OF THE INVENTION

Figure 1:
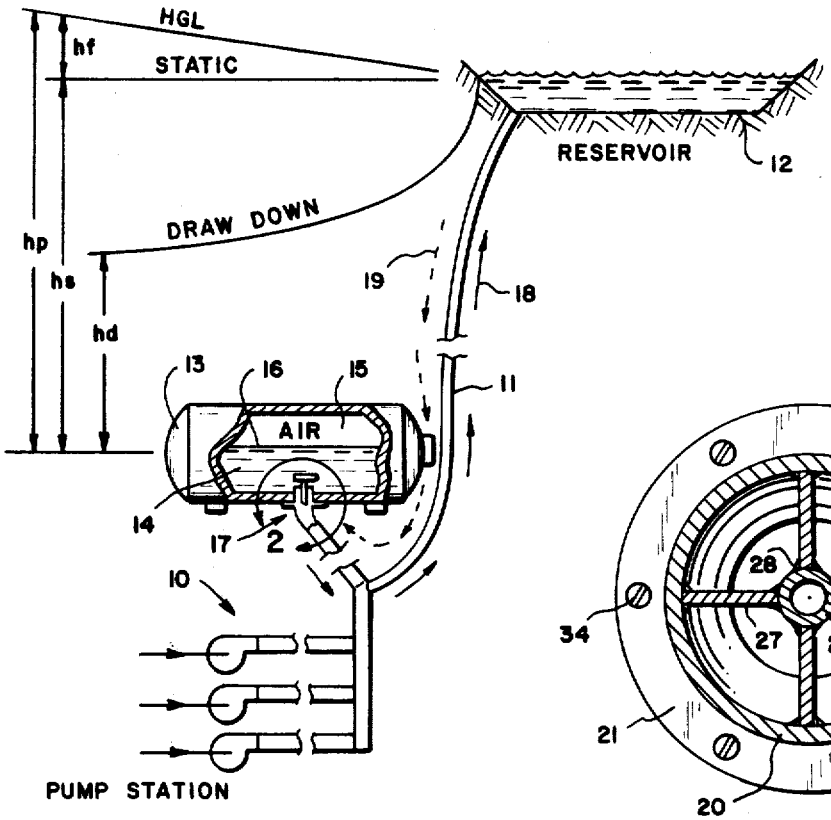
FIG. 1 is a highly schematic illustration of a surge chamber in accord with the present invention as used in a pumping system for maintaining a reservoir filled with water.

Referring to the lower portion of FIG. 1 there is schematically illustrated at 10 a pumping station for transferring water through a pipeline 11 to a higher level, such as into a reservoir 12. In order to avoid water hammer should there be a power outtage resulting in a shutdown of the pumping station, there is provided the surge chamber 13 of the present invention.

As shown in the broken away portion, the surge chamber 13 is approximately half filled with a fluid, such as water 14, the air shown at 15 above the water-air surface 16 being charged to a given pressure. In accord with an important feature of this invention, the outflow/inflow fitting 17 is disposed in the bottom wall of the chamber 13. Essentially, this fitting is designed to control fluid flow from the surge chamber 13 to the pipeline 11 in a manner to prevent fluid separation of the fluid column in the pipeline should the pumping system fail. Thus, in FIG. 1, the outflow of fluid from the chamber 13 is indicated by the solid line arrows 18 and the return fluid surge to the chamber is indicated by the dotted line arrows 19.

Referring to the upper left portion of FIG. 1, the pump head pressure is indicated at hp and includes the static head plus the pipeline friction head designated hf as determined by the hydraulic grade line HGL. The drawdown head pressure hd is shown for the outflow of fluid from the surge tank wherein it will be evident that the outflow pressure gradually decreases to slow down the water column in the pipeline without permitting separation of the water column. On the return surge, the drawdown head pressure hd will increase to complete a cycle.

Figure 2:
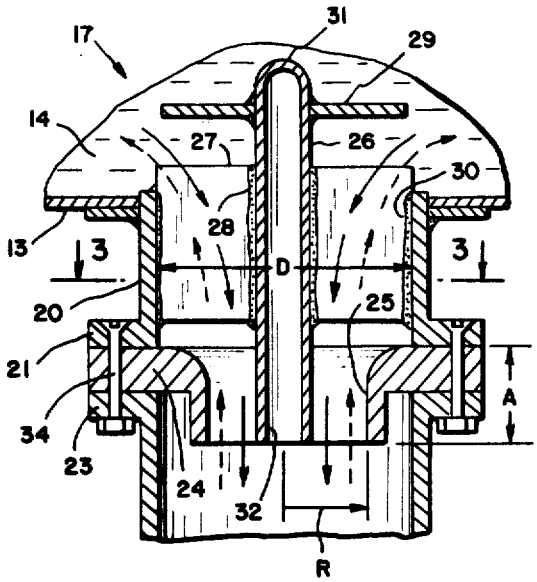
FIG. 2 is an enlarged cross section of the outflow/inflow control fitting on the surge chamber encompassed within the circular arrow 2 of FIG. 1, illustrating a first embodiment of this invention.

Referring now to FIG. 2, details of the outflow/inflow fitting 17 of FIG. 1 will become evident. As shown, this fitting includes a surge chamber pipe section 20 of given inside diameter D in the bottom wall of the chamber in communication with the interior water 14 thereof. Pipe section 20 extends downwardly away from the chamber and has a first exterior annular flange 21 on its lower end. An outlet pipe section 22, in turn, has the same given inside diameter D as the pipe section 21 and has a second exterior companion annular flange 23 on its upper end. An annular nozzle member 24 defines a reduced diameter opening 25 of diameter less than said given diameter D. This nozzle 24 is positioned between and coaxially aligned with the first and second flanges 21 and 23 as shown.

Still referring to FIG. 2, there is shown a coaxially positioned core member 26 carrying radially extending anti-vortex blades 27 secured at their inner ends to the core 26 as by welding 28. Blades 27 are centrally positioned in the surge chamber pipe section 20, the lower end of the core member passing coaxially within the reduced diameter opening 25 of the nozzle member to terminate in the plane of the lower end of the reduced diameter opening.

The fitting is completed by the provision of a baffle member 29 carried on the upper end of the core member 26 above the anti-vortex blades 27 in a position to deflect fluid passing up through the anti-vortex blades laterally. This action will minimize agitation of the fluid-air surface in the surge chamber 13 designated 16 in FIG. 1 during inflow of fluid from the pipeline to the surge chamber.

In the particular embodiment illustrated in FIG. 2, the lateral end edges of the anti-vortex blades 27 are secured as by welding to the inside cylindrical wall of the surge chamber pipe section 20 as indicated at 30. The core 26 and anti-vortex blades 27 are thus disconnected or free of the nozzle member 24 which can readily be removed from between the companion flanges 21 and 23 of the pipe sections 20 and 22 respectively. A nozzle member having a restricted passage or central opening of different diameter can thus be substituted for that shown without disturbing the core or radial blades.

Also as shown in the particular embodiment of FIG. 2, the core member 26 is hollow, having a closed upper end 31 and open lower end 32. The nozzle opening 25 itself extends downwardly with the core member coaxially a distance designated by the letter A. This axial distance is at least equal to the radius R of the opening 25. By rounding the upper periphery of this nozzle construction as indicated at 33, the return flow indicated by the dashed arrows of fluid is throttled, the vena contracta restricting the flow to give a differential throttling device of about 2:1. By further extending the core piece through the nozzle orifice or opening as shown, the wake effect on the return flow causes differential throttling in the order of 6:1. Finally, by making the core piece hollow as described in the embodiment of FIG. 2, it will develop what is known as a "borda" mouthpiece flow pattern turned inside out. With this arrangement, the differential friction losses are in the order of 12:1.

As mentioned before, with the embodiment of FIG. 2 it is a simple matter to substitute in a new nozzle structure for the nozzle 24. Towards this end, it is only necessary to remove the fastening bolts, such as the bolt 34 securing the flanges 21 and 23 together. This operation can be carried on from the exterior of the surge chamber.

Figure 3:
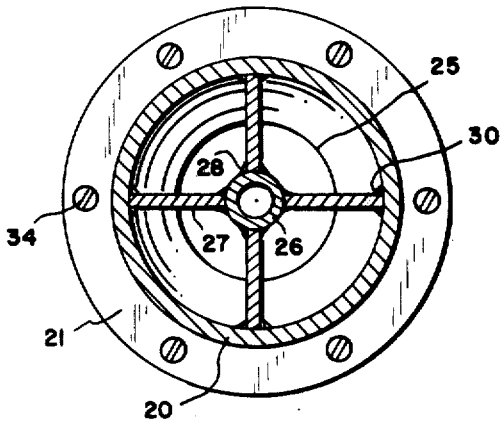
FIG. 3 is a plan cross section in the direction of the arrows 3—3 of FIG. 2 and, FIG. 4 is a cross section similar to FIG. 2 illustrating a modified embodiment of the invention.

Referring now to FIG. 3, it will be noted that there are provided six such bolts 34 for securing the flanges the upper flange for the pipe section 20 being illustrated at 21. Also, it will be noted in FIG. 3 that there are provided four anti-vortex radial blades 27 secured as described at 30 to the interior wall of the pipe section 20. However, there could be provided three such radial blades spaced at 120° if desired, or even a greater number than the four illustrated. As mentioned heretofore, the anti-vortex blades will prevent depression of the water-air surface in the surge tank as would occur if a vortex were created.

Figure 4:
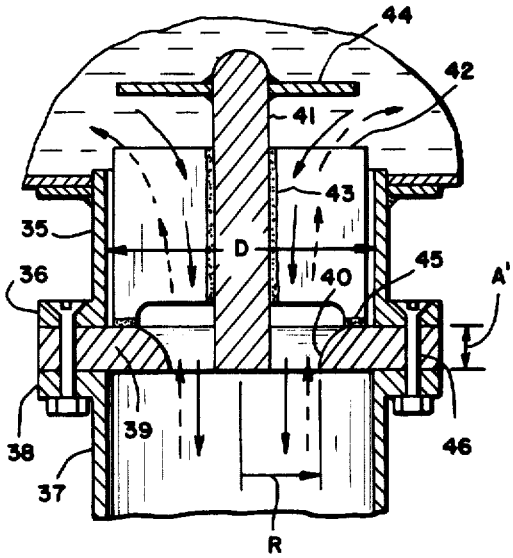

Referring now to FIG. 4, there is shown a modified embodiment of the outflow/inflow fitting which would be used under less stringent conditions than those for which the fitting shown in FIG. 2 would normally be used.

As shown in FIG. 4, there is again provided a surge chamber pipe section 35 extending downwardly from the bottom of the chamber to terminate in a first exterior annular flange 36. An outlet pipe section 37 in turn has a companion second annular flange 38 for mating with the flange 36 in a manner similar to that described for the pipe sections 20 and 22 of FIG. 2.

Rather than a nozzle of the type shown at 24 in FIG. 2, the nozzle of FIG. 4 takes the form of an orifice plate 39 having a reduced diameter opening 40. A core member 41 is provided for carrying radially extending anti-vortex blades 42 secured to the core member on their inner ends as 43. Core member 41 also carries a baffle 44 on its upper end as shown, the lower end of the core member terminating in the plane of the lower end opening 40.

In the modified embodiment of FIG. 4, the lower ends of the radial blades 42 are secured to the orifice plate or nozzle 39 as indicated at 45, these blades being free of the interior wall of the pipe section 35. With this arrangement, the nozzle or orifice plate 39, core 41 and radial blades 42 along with the baffle plate 44 can be removed as a unit by first disconnecting the outlet pipe section 37 by removing bolts 46. Again, this operation can be effected from the exterior of the tank or chamber.

The orifice plate 39 differs from the nozzle 24 described in FIG. 2 in that the axial extent of the central opening 40 is substantially less than the axial extent of the central opening 25 of the nozzle. Thus, as shown in FIG. 4, the axial extent is indicated at A' and is less than the radius of the opening indicated by the letter R.

Also in FIG. 4, the core 41 is solid rather than hollow. The solid core, in combination with the shallow orifice plate can be used as noted under conditions less stringent than those for which the fitting of FIG. 2 would be used: that is, where the head pressures described in FIG. 1 are substantially less. For example, the return flow differential throttling for the fitting of FIG. 4 would be about 1.61:1 considering the orifice opening 40 with its rounded upper end by itself. With a solid core extending through the orifice plate opening 40 as shown, the wake effect as in the case of FIG. 2 would result in a differential throttling in the order of 4:1.

From all of the foregoing, it will now be evident that the present invention has provided a greatly improved surge chamber. By providing the outflow/inflow fitting on the bottom of the chamber, maximum use is made of the fluid within the chamber with a minimum of structure actually positioned inside the chamber which would cause contamination. Moreover, the provision of the anti-vortex blades along with the baffling plate minimizes disturbance of the fluid-air surface in the surge tank so that minimum air absorption in the fluid results. Finally, the fitting can be very easily disassembled to interchange parts as described by the simple mating flange arrangement supporting the nozzle.

While a generally flat or disc-shaped baffle plate such as indicated at 29 in FIG. 2 or 44 in FIG. 4 has been illustrated, it should be understood that this plate can have a conically shaped undersurface or be of other suitable shape if desired. The invention, accordingly, is not to be thought of as limited to the specific construction set forth merely for illustrative purposes.

I claim:

1. A surge chamber having an outflow/inflow control fitting on its bottom, said fitting including, in combination:

(a) a surge chamber pipe section of given inside diameter secured in the bottom wall of said chamber in communication with the interior thereof, said pipe section extending downwardly away from the chamber and having a first exterior annular flange on its lower end;

(b) an outlet pipe section of said given inside diameter and having a second exterior companion annular flange on its upper end;

(c) an annular nozzle member defining a reduced diameter opening less than said given diameter, positioned between and in coaxial alignment with the first and second annular flanges; and (d) a coaxially positioned core member carrying radially extending anti-vortex blades centrally positioned in said surge chamber pipe section with the lower end of said core member passing coaxially within said reduced diameter opening in said nozzle member and terminating in the plane of the lower end of said reduced diameter opening, said outlet pipe section connecting to a pipeline carrying a column of fluid being pumped to a higher level by pumps in a pumping station, said inside diameter and reduced diameter opening, and the geometry of said nozzle member being sized to provide a controlled outflow of fluid from said surge chamber to said pipeline in a manner to avoid separation of said fluid column in the event of failure of the pumps, for example, as a result of a power outtage.

2. The combination of claim 1, including a baffle member carried on the upper end of said core member above said anti-vortex blades in a position to deflect fluid passing up through said anti-vortex blades in a lateral direction to thereby minimize fluid surface agitation in said surge chamber during inflow of fluid from said pipeline into said surge chamber.

3. The combination of claim 1, in which the lateral end edges of said anti-vortex blades are secured to the inside cylindrical wall of said surge chamber pipe section to secure the central positioning of said core member and radially extending anti-vortex blades, said annular nozzle member constituting a separate member removable from between said first and second flanges so that the nozzle member alone can be removed and a new nozzle member having a different dimensioned reduced diameter opening substituted therefor from the exterior of said surge chamber.

4. The combination of claim 1, in which the bottom edge portions of said anti-vortex blades are secured to said nozzle member so that said core, blades and nozzle member are removable as a unit from the exterior of said surge chamber by removing said nozzle member from between said first and second annular flanges.

5. The combination of claim 1, in which said core member is hollow, having a closed upper end and an open lower end, said reduced diameter opening in said nozzle member having a rounded upper periphery and extending downwardly an axial distance at least equal to its radius.

6. The combination of claim 1, in which said core member is solid, said reduced diameter opening in said nozzle member comprising an orifice having a rounded upper periphery and having an axial extent less than its radius.

* * * * *